428-570 SR
2/17/87 XR 4,643,765

United States Patent [19]
Takajo

[11] Patent Number: 4,643,765
[45] Date of Patent: Feb. 17, 1987

[54] TIN-CONTAINING FERROUS COMPOSITE POWDER AND METHOD OF PRODUCING SAME AND TIN-CONTAINING SINTERED MAGNETIC MATERIAL

[75] Inventor: Shigeaki Takajo, Chiba, Japan

[73] Assignee: Kawasaki Steel Corporation, Chuo, Japan

[21] Appl. No.: 743,480

[22] Filed: Jun. 11, 1985

[30] Foreign Application Priority Data

Jun. 18, 1984 [JP] Japan ..... 59-124952

[51] Int. Cl.[4] ..... C22C 33/00
[52] U.S. Cl. ..... 75/0.5 B; 75/255; 428/570
[58] Field of Search ..... 75/0.5 B, 255, 123 L, 75/123 A; 428/570

[56] References Cited

U.S. PATENT DOCUMENTS 3,161,948 12/1964 Bechtold ..... 75/123 L
3,254,990 6/1966 Goering ..... 75/123 L
3,429,696 2/1969 Werley ..... 75/255
4,174,235 11/1979 Fiedler ..... 75/123 A
4,293,336 10/1981 Matsumura ..... 75/123 A
4,540,437 9/1985 Patel ..... 75/255

*Primary Examiner*—Peter D. Rosenberg
*Attorney, Agent, or Firm*—Austin R. Miller

[57] ABSTRACT

As the raw material of a ferrous sintered alloy, a ferrous composite powder excellent in both compressibility and distribution of alloying elements is obtained by mixing an iron powder or a Sn-free low-alloy iron powder with at least one secondary powder comprising at least one of C, Co, Cr, Cu, Mn, Mo, Ni, P and Si and another powder comprising Sn and heating the powder mixture in a nonoxidizing atmosphere at 250°–900° C. to result in that the secondary powder(s) is at least partially bonded to the iron particles with Sn as a sort of cementing medium. In the powder mixture the content of Sn is 0.1–20 wt %, and the weight ratio of the secondary powder(s) to Sn is not greater than 50:1. Also disclosed is a ferrous sintered magnetic material high in magnetic flux density and small in iron loss, which contains 1–12 wt % of Si, 0.05–7 wt % of Sn and, optionally, 0.05–2 wt % of P and in which Sn concentrates on the surfaces of iron particles.

15 Claims, 7 Drawing Figures

TIN-CONTAINING FERROUS COMPOSITE POWDER AND METHOD OF PRODUCING SAME AND TIN-CONTAINING SINTERED MAGNETIC MATERIAL

BACKGROUND OF THE INVENTION

This invention relates to a tin-containing ferrous composite powder useful as the raw material of a ferrous sintered alloy and a method of producing the ssame and to a tin-containing ferrous sintered magnetic material.

With the development of powder metallurgy, ferrous sintered materials are increasingly used in mechanical and electrical industries. Since various properties are required of practical ferrous sintered materials, a wide variety of alloying elements have been tested and employed to meet such requirements.

Conventional raw material powders for producing ferrous sintered alloys include mixtures of an iron powder with powders of desired alloying elements and alloy iron powders containing desired alloying elements all in prealloyed form. An advantage of a merely mixed powder is good compressibility which is exhibited at the stage of compacting the powder into a desired shape prior to sintering. This advantage is derived from softness of the unalloyed iron powder as the primary ingredient of the mixed powder. However, it is a disadvantage that the mixed powders of the alloying elements tend to segregate to result in nonuniform alloying with iron at the stage of sintering. In the case of a prealloyed iron powder there is little problem as to the uniformity of alloying. However, alloy iron powders are generally inferior in compressibility due to hardening of the powder particles by alloying.

To solve such problems of conventional ferrous powders for sintering, there are proposals for partially alloyed ferrous powders in which alloying elements are partly bonded to iron particles without significantly diffusing into iron: e.g. Japanese patent application publication No. 45-9649 (1970: bond of Mo, Cu and Ni to iron powder) and Japanese patent application provisional publication No. 53-92306 (1978: bond of Cu to iron powder). According to these proposals, a mixture of an iron powder and alloying element source powders is heated to accomplish partial bonding of particles of the latter powders to the iron particles. However, for a success in the desired bonding of the particles without diffusion of the alloying elements into the iron particles, the conditions of the heating must be determined within a very narrowly limited range and the freedom in selecting alloying elements is also restricted. Furthermore, even though the desired partial bonding of the particles is attained there is a possibility of separation of the once bonding alloying element particles from the iron particles during subsequent handling of the partially alloyed powder, and such breaking of bonds between the particles will become a cause of segregation at the stage of sintering this powder.

Meanwhile, there is a trend to use ferrous sintered materials for some parts of electrical devices such as iron cores of motors in view of soft magnetism the sintered materials possess. In general, such parts of ferrous sintered materials are produced by a powder metallurgical method including the steps of adding about 0.15–1.0 wt% of a powdery lubricating agent such as zinc stearate to a raw material powder, which may be either an iron powder or an alloy iron powder and may optionally contain secondary powders as sources of desired alloying elements, compacting the resultant powder mixture in a metal die under a pressure of about 3000–10000 kg/cm$^2$, and sintering the compacted material in a nonoxidizing atmosphere usually at a temperature of 1000°–1350° C. Where necessary the sintered body is precisely shaped by sizing or machining.

An advantage of ferrous sintered materials over the conventional iron core materials typified by laminated silicon steel sheet is a large freedom in shaping. However, it is a serious disadvantage of ferrous sintered materials that they are inferior in the alternating-current magnetic characteristics due to being very large in the iron loss. The reason is because eddy current is liable to be induced in the sintered part, which is an integral member different from a laminate, so that an eddy-current loss becomes extraordinarily great.

Therefore, efforts have been made to decrease the eddy-current loss by increasing the electrical resistances of ferrous sintered materials by effective alloying. Among various alloying elements for iron, silicon has been deemed most effective for increasing the electrical resistance. Accordingly it has long been tried to produce Si-containing ferrous sintered parts of good properties by initially mixing either elemental silicon powder or ferrosilicon powder with iron powder. However, full success has not been obtained because the addition of Si causes lowering of the green density of the raw material for sintering and, therefore, results in lowering of the sintered density. Sintered parts low in the sintered density are naturally low in the magnetic flux density. As a solution to this problem, Japanese patent application publication No. 40-12045 (1965) proposes to add phosphorus together with silicon to an iron powder with a view to improving the manner of sintering of the raw material powder and consequently enhancing the sintered density and magnetic characteristics of the products. Actually, fairly high sintered densities, viz. 7 g/cm$^3$ or above, can be attained by the addition of P when the content of Si is up to about 3 wt%. However, when the content of Si is more than 3 wt% it is impossible to attain a sufficiently high sintered density even though a considerable amount of P is added.

SUMMARY OF THE INVENTION

It is an object of the present invention to provide a ferrous composite powder useful as the raw material for producing a ferrous sintered alloy, which is free from the above described disadvantages of conventional ferrous alloy or composite powders for sintering and in which the particles containing alloying elements firmly combine with iron particles so that freedom of selecting alloying elements is greatly expanded without offering difficulties to compacting and sintering of the powder.

It is another object of the invention to provide a method of producing a ferrous composite powder according to the invention.

It is still another object of the invention to provide a silicon-containing ferrous composite powder which has the above-stated merits of the invention and can provide sintered bodies sufficiently high in sintered density.

It is a further object of the invention to provide a silicon-containing ferrous sintered magnetic material which is high in density, permeability and magnetic flux density despite the use of silicon to decrease iron loss.

A fundamental feature of the invention is to use tin as an assistant to combine particles of selected alloying elements with iron particles. It is well known that Sn serves as a good alloying element in producing ferrous sintered alloys. In general, Sn contributes to improvements in the strength, hardness, machinability, corrosion resistance and/or magnetic characteristics of sintered ferrous alloys. Besides, the addition of Sn which has a low melting point (230° C.) makes it possible to lower the sintering temperature without degrading the properties of the sintered material. These favorable effects of Sn as an alloying element are utilized also in the present invention. Moreover, the inventor's novel ideal is coating the individual particles of iron with tin prior to sintering of the powder mixture containing other alloying elements.

The present invention provides a tin-containing ferrous composite powder useful as the raw material of a ferrous sintered alloy, which comprises a primary powder of which the principal material is Fe and which is substantially free of Sn, at least one secondary powder which comprises at least one alloying element selected from C, Co, Cr, Cu, Mn, Mo, Ni, P and Si, and tin in such a form that the individual particles of the primary powder and at least a portion of the particles of the secondary powder(s) are at least partially coated with Sn such that particles of the secondary powder(s) are bonded to the individual particles of the primary powder via Sn. In this composite powder the content of Sn is in the range from 0.1 to 20 wt%, and the ratio of the total weight of the alloying element(s) in the secondary powder(s) to the weight of Sn is not greater than 50:1.

To produce a novel tin-containing ferrous composite powder as stated above, this invention provides a method which comprises the steps of mixing a primary powder of which the principal material is Fe and which is substantially free of Sn with at least one secondary powder, which comprises at least one alloying element selected from C, Co, Cr, Cu, Mn, Mo, Ni, P and Si, and at least one Sn-source powder selected from tin powder and powders of tin compounds that undergo thermal decomposition to liberate Sn in such proportions that the content of Sn in a resultant powder mixture is in the range from 0.1 to 20 wt% and that the ratio of the total weight of the secondary powder(s) to the weight of Sn in the powder mixture is not greater than 50:1, and heating the powder mixture in a nonoxidizing atmosphere at a temperature in the range from 250° to 900° C.

In the present invention Sn is used primarily as a bonding or cementing assistant to physically combine the particles comprising selected alloying elements with the iron particles in view of the fact that under mild heating Sn provides a liquid phase which is capable of well wetting both iron particles and other alloying element particles. In producing a composite powder of the invention, the starting powder mixture is heated so as to cause melting of Sn and so as not to cause significant diffusion of Sn into the iron particles. The liquid phase of Sn wets the surfaces of both the iron particles and the particles of the other alloying elements and works as a sort of adhesive or soft solder. In the composite powder obtained through the heating, solidified Sn provides strong bonds between the individual iron particles and the particles of the other alloying elements.

In a composite powder of the invention there is little possibility of separation of the secondary powders containing alloying elements from the iron powder during handling of the composite powder prior to a sintering operation since the particles of the secondary powders are firmly bonded to the individual particles of the iron powder via Sn. Therefore, sintering of this composite powder into desired sintered bodies can easily be accomplished without suffering from segregation of the alloying elements. Furthermore, this composite powder is excellent in compressibility since neither Sn nor any other alloying element has diffised deep into the iron particles. Therefore, this composite powder can easily be compacted to a sufficiently high green density, which is a key to a success in producing sintered bodies high in density and excellent in mechanical and/or magnetic properties. Besides, this invention provides wide freedom of selection of alloying elements. In this invention the above named nine kinds of alloying elements other than Sn can freely be employed either singly or in various combinations and in various proportions according to the intended uses of the sintered materials and the properties required of the sintered materials. A tin-containing ferrous composite powder having these merits can easily and economically be produced on an industrial scale by a method stated hereinbefore.

This invention further provides a tin-containing ferrous composite powder which comprises an iron powder, at least one Si-containing powder selected from silicon powder and ferrosilicon powders and tin in such a form that at least a portion of the particles of the iron powder are at least partially coated with Sn. In this composite powder the content of Si is in the range from 1 to 12 wt%, and the content of Sn is in the range from 0.05 to 7 wt%.

This composite powder is mainly for use as the raw material powder of a sintered magnetic material. For improving the magnetic characteristics of the sintered material, it is preferable that the Si-containing composite powder further comprises 0.05 to 2 wt% of P.

In another respect, this invention provides a ferrous sintered magnetic material consisting essentially of 1–12 wt% of Si, 0.05–7 wt% of Sn and the balance of Fe, and another ferrous sintered magnetic material consisting essentially of 1–12 wt% of Si, 0.05–7 wt% of Sn, 0.05–2 wt% of P and the balance of Fe.

As an expansion of the fundamental idea that has lead to the present invention relating to a Sn-containing ferrous composite powder, the inventor has discovered that the manner of sintering and also magnetic characteristics of a sintered magnetic material consisting essentially of Fe and Si can be remarkably improved by the addition of a limited amount of Sn to the raw material powder mixture such that Sn concentrates on the surfaces of the iron particles. By utilizing this discovery it has become possible to produce a Si-containing ferrous sintered magnetic material which is high in electrical resistance and, hence, small in the iron loss and is high in the sintered density and, hence, high in the magnetic flux density. In other words, it has become possible to desirably increase the content of Si in the sintered material without suffering from unfavorable influences of Si on the sinterability of the raw material powder.

The favorable effect of Sn on the sinterability of an iron-silicon powder mixture can be explained from the fact that Sn aids formation of $\alpha$-Fe phase. When $\alpha$-Fe phase exists in the powder subjected to sintering it is likely that sintering proceeds mainly in the manner of so-called $\alpha$-sintering, and consequently the sintering is promoted to give a sintered body high in density. Besides, Sn has the effect of adequately coarsening the sintered crystal grains. In these respects, Sn is a favorable alloying element for ferrous magnetic materials.

However, Sn is not so effective as Si in increasing the electrical resistance.

When a mixture of an iron powder and either an elemental silicon powder or a ferrosilicon powder is compacted for sintering, it is difficult to realize a desirably high green density for the reason explained hereinbefore. If sufficient shrinkage takes place during sintering of the compacted material it will be possible to attain a sufficiently high sintered density. Actually, however, the amount of shrinkage is not so great. Therefore, the sintered material is unsatisfactory in the magnetic flux density and other magnetic characteristics. In theory, Si has a capability of improving sinterability since it too has a tendency to aid formation of $\alpha$-Fe phase by allowing with Fe and is large in the diffusion coefficient in $\alpha$-Fe. Actually, however, such effects of Si can hardly be obtained. Probably the main reason is that Si does not easily diffuse into the iron particles even though the iron particles and the silicon of ferrosilicon particles are physically in contact with each other. At an initial stage of the sintering the iron particles are in $\gamma$-Fe phase, and the diffusion coefficient of Si in $\gamma$-Fe phase is much smaller than in $\alpha$-Fe phase. Furthermore, the contact area between each iron particle and each silicon or ferrosilicon particle is very small. These are presumable reasons for the difficulty in diffusion of Si at the initial stage of the sintering.

From such consideration the inventor conceived the idea that the diffusion of Si into the iron particles will easily take place if the iron particles turn into $\alpha$-Fe phase soon after starting sintering of an iron-silicon mixture. According to this idea it is not necessary that $\alpha$-Fe phase occupies the entire volume of each iron particle, and it is expected to be sufficient that only a shallow surface region of each iron particle turns into a $\alpha$-Fe phase at an initial stage of sintering. Based on this idea, actual success has been obtained by introducing Sn into a mixture of an iron powder and either a silicon powder or a ferrosilicon powder such that Sn concentrates on the surfaces of the iron particles. The desired concentrating of Sn can be realized relatively easily by plating an iron powder with Sn before mixing it with a silicon powder or by heating a powder mixture comprising an iron powder and either a tin powder or a suitable tin compound powder to a temperature above the melting point of Sn.

When a mixture of an iron powder containing Sn as a coating on the iron particles and either a silicon powder or a ferrosilicon powder is compacted and sintered, a surface region of each iron particle coated with Sn turns into $\alpha$-Fe phase at an initial stage of sintering, and therefore diffusion of Si into the iron particles is effectively promoted. Once Si diffuses into the iron particles, the $\alpha$-Fe phase begins to expand toward the core of each iron particle. Accordingly the sintering proceeds in the manner of so-called $\alpha$-sintering, and consequently a sufficiently high sintered density is attained.

For the above explained reasons, a composite powder according to the invention containing Fe, Si and Sn provides a sintered magnetic material which is small in the iron loss and high in the magnetic flux density. Furthermore, the use of Sn is effective for enhancing the permeability and lowering the coercive force of the sintered material. In using Sn for obtaining such an improved sintered magnetic material, the content of Sn is limited to 7 wt% at the maximum because the existence of a larger amount of Sn is unnecessary for the accomplishment of good sintering and is rather unfavorable for the magnetic characteristics of the sintered material.

When an iron-silicon powder mixture contains 0.05–2 wt% of P besides 0.05–7 wt% of Sn, the sinterability of the powder mixture and the magnetic characteristics of the sintered material are further improved. This is because P too has a capability of promoting $\alpha$-sintering.

DESCRIPTION OF THE PREFERRED EMBODIMENTS

Figure 1:
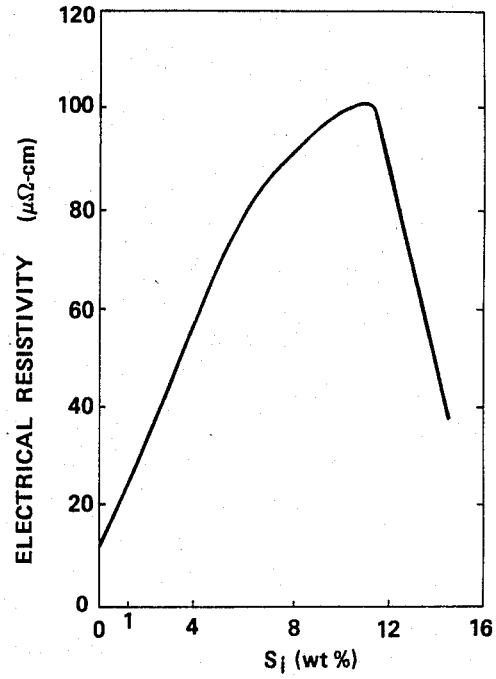
FIG. 1 is a graph showing the dependence of the electrical resistivity of Fe-Si alloy on the content of Si.

First, the particulars of the invention will be described with respect to ferrous composite powders useful as raw materials of sintered materials for general purposes, containing Sn and any one of or any selective combination of C, Co, Cr, Cu, Mn, Mo, Ni, P and Si.

The basic ingredient is either a practically pure iron powder or a low-alloy iron powder that is substantially free of Sn. For example, reduced iron powder in which the content of Fe is 98.5% or above and atomized iron powder in which the content of Fe is 99.0 wt% or above are readily available as parctically pure iron powders. If desired a low-alloy iron powder, such as one consisting of at least one of 1.3–1.6% of Ni, 0.2–0.6% of Mo, 0.4–0.7% of Cu and 0.9–1.2% of Cr and the balance of Fe and inevitable impurities, can be used.

As to the alloying elements other than Sn, it is optional whether to use practically pure powders of the respective elements or to use powders of suitable alloys of desired elements, and it is also possible to use powders of compounds each of which undergoes thermal decomposition and liberates a desired alloying element during the heat treatment for melting Sn. According to the kind of the alloying element a suitable form should be chosen with consideration of wettability with molten tin and reactivities in the presence of molten tin.

Carbon is an indispensable element if it is intended to produce a sintered alloy steel. When using this element as an ingredient of the composite powder it is usual to use a graphite powder. Graphite particles can be bonded to iron particles with Sn as a cementing medium because graphite particles are easily and well wettable with molten tin while iron particles too are well wettable with molten tin and tend to form interfacial Fe-Sn compounds. Alternatively, a carbide powder may be used as a C-containing powder.

Cobalt is an alloying element useful for both mechanical parts and magnetic parts since Co contributes to enhancement of the strength of a ferrous sintered material by forming a solid solution with Fe and, besides, has the effect of enhancing the saturation magnetic flux density of a ferrous magentic material. A powder of metallic cobalt is easily wetted with molten tin and tends to form interfacial Co-Sn compounds. Accordingly cobalt particles can easily be bonded to iron particles with Sn as a cementing medium.

Chromium is an alloying element useful for the purpose of improving the strength, hardness and corrosion resistance of iron. When including Cr in the composite powder it is preferable to use a ferrochromium powder because it is well wettable with molten tin and accordingly can firmly be bonded to iron particles.

Manganese has the effect of improving the strength, toughness and hardenability of a ferrous material. For a composite powder containing Mn, it is preferably to use a ferromanganese powder. Since ferromanganese is well wettable with molten tin and tends to form Mn-Sn compounds, good bonding of Mn to iron particles can be accomplished.

Molybdenum has the effect of enhancing the strength and hardness of a ferrous material. For a Mo-containing composite powder, a powder of metallic molybdenum, a ferromolybdenum powder of a molybdenum oxide powder may be used. In every case the Mo-containing powder is firmly bonded to the iron particles with Sn as a cementing medium.

Nickel is an important element to obtain a ferrous material high in both strength and toughness. Either a powder of metallic nickel or a nickel oxide powder can be used for a Ni-containing composite powder. In either case the Ni-containing powder is highly reactive with molten tin and accordingly is firmly bonded to the iron particles through the heat treatment for melting Sn.

Phosphorus has the effect of improving the strength and toughness and also magnetic characteristics of a ferrous material. For a P-containing composite powder, a red phosphorus powder, a ferrophosphorus powder or a phosphorus oxide powder can be used. In every case the P-containing powder is liable to react with Sn and accordingly is surely bonded to the iron particles in the presence of Sn.

Silicon has the effect of improving the strength and magnetic characteristics of a ferrous material. For a Si-containing composite powder it is preferable to use either a powder of elemental silicon or a ferrosilicon powder. In either case the Si-containing powder is well wettable with molten tin and, therefore, can be bonded to the iron particles.

As to the source of Sn to be introduced into the composite powder, it is a matter of course that a powder of metallic tin is useful. Alternatively it is possible to use a powder of a tin compound which decomposes by heating into Sn and gaseous substances, such as tin oxide ($SnO$ or $SnO_2$), tin hydroxide ($Sn(OH)_2$ or $SnO_2.nH_2O$), tin chloride ($SnCl_2$ or $SnCl_4$, which may have water of crystallization), tin sulfide ($SnS$ or $SnS_2$), tin nitrate ($Sn(NO_3)_2$ or $Sn(NO_3)_4$, which may have water of crystallization) of tin sulfate ($SnSO_4$).

In the case of metallic tin, it is not always easy to obtain a fine powder suitable for uniform mixing with a powder of iron or low-alloy iron by an ordinary pulverization method. Besides, it is rather inconvenient that metallic tin immediately melts when heated to a temperature only slightly above the melting point, 230° C., because if the temperature at the heat treatment of the powder mixture is made somewhat higher diffusion of Sn into the iron particles is likely to occur. The diffusion of Sn results in hardening of the iron particles and, hence, in degradation of the compressibility of the composite powder. For these reasons, in some cases it is rather preferable to use a tin compound powder. Therefore, care should be taken to made good selection of the source of Sn with consideration of the kinds of other alloying elements and the heat treatment temperature. If desired a tin compound powder may be used together with a metallic tin powder and/or at least one different kind of tin compound powder.

It is important that both the powder(s) used as the source of Sn and the powder(s) containing the other alloying element(s) be smaller in particle size than the powder of iron or low-alloy iron. Otherwise, the powder(s) containing the alloy element(s) cannot surely be bonded to the iron or low-iron particles even though Sn is utilized.

The selected source of Sn is used in such a quantity that the content of Sn in the composite powder falls in the range from 0.1 to 20% by weight. Where a tin compound powder is used the quantity of that powder should be controlled on the basis of Sn contained in the tin compound. If the content of Sn in the composite powder is less than 0.1 wt% the effect of Sn as the bonding assistant and or cementing medium is not appreciable. On the other hand, when the content of Sn exceeds 20 wt% it is likely that the composite powder becomes nonuniform because of local agglomeration of excess Sn during the heat treatment of the starting powder mixture.

Aside from Sn, the contents of the respective alloying elements in the composite powder are not particularly specified. However, in the starting powder mixture the total quantity of the powders containing alloying elements other than Sn is limited such that the ratio of the total weight of these powders to the weight of Sn contained in the powder mixture is not greater than 50:1. When this requirement is not met, the quantity of Sn as the bonding assistant becomes insufficient so that the powders containing the other alloying elements are not always firmly bonded to the iron particles, whereby segregation of alloying elements will possibly occur at the stage of sintering of the composite powder. To ensure that the total quantity of the powders containing alloying elements other than Sn will never exceed the aforementioned maximum limit, the composite powder is specified to be not greater than 50:1 in the weight ratio of the total of the selective alloying elements to Sn.

The heat treatment of the starting powder mixture for the purpose of establishing the desired bonds between the particles by temporarily melting Sn must be performed in a nonoxidizing atmosphere. For example, the heat treatment may be performed in nitrogen gas or under vacuum. A reducing atmosphere such as a hydrogen gas atmosphere is employed when reduction of some ingredients, such as tin oxide as the source of Sn and copper oxide as the source of Cu, is wished.

The heating temperature for the heat treatment is limited within the range from 250° to 900° C. Though the melting point of Sn is 230° C., the lower limit of the heating temperature is set at 250° C. because at temperatures just above the melting point the melt of Sn will not well wet the coexisting solid particles. The upper limit of the heating temperature is set with the intention of minimizing the diffusion of Sn or any other alloying element into the iron particles. If any of these elements diffuses deep into the individual particles of iron or low-alloy iron, the resultant composite powder is inferior in compressibility due to hardening of the iron particles. Where metallic tin is used in the absence of other alloying elements, diffusion of Sn deep into the iron particles begins as the heating temperature exceeds about 450° C. Where tin oxide is used the same phenomenon begins as the heating temperature exceeds about 700° C. In general diffusion of other alloying elements into iron begins at higher temperatures. When Sn and powders containing other alloying elements are coexisting, substantial diffusion of Sn into the iron particles begins at a considerably high temperature because Sn first reacts with other alloying elements. However, even in such cases substantial diffusion of Sn into the iron particles will take place if the heating temperature is above 900° C. The upper boundary of the permissible range of the heating temperature is set in view of these facts and tendencies. The effects of the liquid phase of Sn produced in the powder mixture by the heat treatment are as described hereinbefore.

Here a note is made on the heating temperature. When producing a composite powder consisting essentially of Fe, Si and Sn, or Fe, Si, Sn and P, for use as the raw material powder of a sintered magnetic material, diffusion of Sn into the iron particles to some extent is rather favorable for improvements of the magnetic properties of the sintered material. In such a case the heat treatment of the starting powder mixture may be carried out at a temperature higher than 900° C. even though the compressibility of the obtained composite powder is somewhat sacrificed.

It is possible to judge whether Sn is actually serving as a cementing medium in the obtained composite powder or not by examining the manners of distributions of the elements concerned in a plane sectional of a particle of iron. An affirmative judgment can be made when Sn exists between the iron particle surface and close-by particles containing the selected alloying element(s). More specifically, an accurate judgement can be made by making lineal analysis from the surface of an iron particle toward the particle core by means of X-ray microanalyzer, for example. When Sn is serving as a cementing medium, a concentration peak of Sn must exist between a concentration peak of Fe corresponding to the sectioned iron particle and additional concentration peak(s) of the selected alloying element(s) such as, for example, C, Co, Cu and/or Cr with respect to at least some of the examined iron particles. However, the interposing Sn is not necessarily in elemental form because in some cases Sn reacts with Fe and/or the selected alloying elements such as C, Co, Cu and/or Cr.

The following is a description of the particulars of Sn-containing sintered magnetic materials according to the invention and composite powders for producing the magnetic materials.

The essential constituents of the novel sintered magnetic material are Fe, Si and Sn. A practically pure iron powder is used as the source of Fe, and either a metallic silicon powder or a ferrosilicon powder as the source of Si. Sn can be introduced in various forms as will be described later.

The content of Si in the sintered magnetic material is limited within the range from 1 to 12 wt%. In Fe-Si binary alloys, the relationship between the content of Si and the electrical resistivity is generally as shown in FIG. 1. To improve the alternating-current magnetic characteristics of a ferrous sintered material there is the need of increasing the electrical resistance because the iron loss of the sintered material is nearly inversely proportional to the electrical resistance. As can be see in FIG. 1, when the content of Si is 1% the electrical resistance is about two times as high as the resistance of pure iron, so that the iron loss decreases by about 50%. It is necessary to increase the electrical resistance at least to such an extent. Besides, without using Si it is possible to make the electrical resistance of iron about two times as high by the addition of P which is better in respect of sinterability. Therefore, the addition of less than 1% of Si is of little meaning. The upper limit of the content of Si is set at 12% since the addition of a larger amount of Si causes lowering of the electrical resistance, as can be seen in FIG. 1.

The favorable effects of Sn on the sintered density and magnetic characteristics of the sintered Fe-Si base magnetic material and the reason for such effects are described hereinbefore. In respect of increasing the electrical resistance, Sn is not so effective as Si. Accordingly both Sn and Si are used in the sintered magnetic materials of the invention.

The content of Sn in the sintered magnetic material is limited within the range from 0.05 to 7 wt%. If the amount of Sn is less than 0.05% the formation of $\alpha$-Fe phase at an initial stage of sintering remains insufficient. On the other hand, when the content of Sn exceeds 7% the magnetic characteristics becomes rather inferior. Probably the reason is that when such a large amount of Sn exists in the powder mixture under sintering the diffusion of Si into the iron particles is obstructed by a Fe-Sn compound phase which is formed, besides the desired $\alpha$-Fe phase, by reaction of excess Sn on the iron powder surfaces with Fe.

In a composite powder as the raw material of a Si- and Sn-containing sintered magentic material, Sn is required to concentrate on the surfaces of the individual iron particles. As mentioned hereinbefore, it is possible to meet this requirement by plating an iron powder with Sn or by heating a mixture of an iron powder and a tin powder prior to the addition of Si to the iron powder. The same result is obtained by heating a mixture of an iron powder and a tin powder in a reducing gas atmosphere. For uniformly concentrating Sn on the iron particle surfaces, tin oxide is advantageous over a metallic tin powder because the oxide is relatively easy to obtain in fine powder form. If desired, a different kind of tin compound that decomposes by heating to liberate Sn, such as tin chloride, tin hydroxide or tin oxalate, may be used instead of tin oxide.

It is preferable to force a liquid phase of Sn to contact with an iron powder while a desired amount of silicon powder or ferrosilicon powder is coexisting, because then the melt of Sn serves the purpose of bonding silicon or ferrosilicon particles to the iron particles while coating the surfaces of the iron particles. This is effective for preventing segregation of Si at the stage of sintering the composite powder as described hereinbefore.

The heating of a mixture of an iron powder and a source of Sn, and preferably a silicon or ferrosilicon powder too, is done at a temperature sufficiently higher than the melting point of Sn. In producing a composite powder as the raw material of a sintered magnetic material, it is favorable that Sn diffuses shallowly into surface regions of the iron particles because the diffused Sn aids transformation of the iron particle surface regions into α-Fe phase at an initial stage of sintering of the composite powder. To realize such diffusion of Sn, sometimes it is desirable to employ a heating temperature higher than 900° C., which is the upper limit in the case of producing a general purpose composite powder according to the invention. That is, when producing the raw material powder for a novel sintered magnetic material according to the invention the temperature at the heating of the starting powder mixture for melting Sn may be raised up to about 1150° C. The compressibility of the obtained composite powder is somewhat sacrificed as the heating temperature is made higher than 900° C., but this is well compensated for by improvements in the magnetic characteristics of the sintered products. When the heating temperature is considerably high, diffusion bonding is likely to occur between a portion of the silicon or ferrosilicon particles and the iron particles. Accordingly the role of Sn as a cementing medium can be lightened. For this reason, the minimum content of Sn in the composite powder is lowered to 0.05 wt%.

The sinterability of a Fe-Si-Sn composite powder according to the invention and magnetic characteristics of the sintered material can further be improved by the addition of a relatively small amount of P, which is known as an element that promotes α-sintering. When the content of P in the composite powder is less than 0.05 wt% the expected effects are not appreciable. However, the content of P is limited to 2 wt% at the maximum because the existence of a larger amount of P will cause precipitation of some nonmagnetic substances and resulting degrading of magnetic characteristics.

When producing a composite powder containing P, it is suitable to use either a ferrophosphorus powder or a red phosphorus powder. When a composite powder is produced by heating a mixture of an iron powder, a silicon or ferrosilicon powder and a phosphorous or ferrophosphorus powder, P contained in the composite powder is also effective for prevention of segregation at the stage of sintering the composite powder.

In practice it is inevitable that a composite powder according to the invention as the raw material of a magnetic material and the obtained sintered magnetic material contain small amounts of impurities. For good magnetic characteristics of the sintered material, it is desirable that the impurities be as small as possible. Considering the industrial restrictions too, it is suitable to limit the main impurities to the following levels.

C: less than 0.02%, Mn: less than 0.4%, S: less than 0.02%; O: less than 0.3%, N: less than 0.01%.

The invention will further be illustrated by the following nonlimitative examples.

EXAMPLES 1-8

Throughout Examples 1 to 8 an atomized pure iron powder was used as the iron source. The iron powder was sieved to use only the particles between 100 mesh and 150 mesh. In Example 1, a powder mixture was prepared by mixing 79 parts by weight of the iron powder with 18 parts by weight of a tin powder (−250 mesh) and 3 parts by weight of a graphite powder (−250 mesh). By calculation the weight ratio of the graphite powder to Sn contained in this power mixture was 0.17:1. In a nitrogen gas atmosphere the powder mixture was heated at 270° C. for 60 min.

In Examples 2-8, differently composed composite powders were produced by varying the kind and/or amount of the Sn source, selectively using various kinds of powders (all −250 mesh) containing selected alloying elements and varying the conditions of the heat treatment of the starting powder mixture. The particulars are shown in Table 1.

REFERENCES 1-5

For comparison, four kinds of Sn-containing composite powders and another composite powder not containing Sn were prepared by modified methods not in accordance with the invention. In these experiments, the atomized iron powder mentioned in Example 1 and at least one of the alloying element source powders used in the Examples were used. The particulars were as shown in Table 1.

TABLE 1

| | Sn Source (wt %) | Sources of Other Alloying Elements (A*) (wt %) | Calculated Composition (wt %) | Weight Ratio of A* to Sn | Heating Atmosphere | Heating Temperature (°C.) |
|---|---|---|---|---|---|---|
| Ex. 1 | Sn (18.0) | graphite (3.0) | 3.0C—18Sn | 0.17 | $N_2$ | 270 |
| Ex. 2 | Sn (0.15) | Co (1.0) | 1.0Co—0.15Sn | 6.7 | $3H_2 + N_2$ | 400 |
| Ex. 3 | Sn (0.30) | Fe—61.2Cr (1.3) | 0.8Cr—0.3Sn | 4.3 | vacuum (0.01 Torr) | 400 |
| Ex. 4 | SnO (0.57) | Cu (2.5) | 2.5Cu—0.5Sn | 5.0 | $3H_2 + N_2$ | 600 |
| Ex. 5 | Sn (0.30) | Fe—74.5Mn (0.67) | 0.5Mn—0.3Sn | 2.2 | vacuum (0.01 Torr) | 400 |
| Ex. 6 | SnO (0.11)<br>$SnO_2$ (0.06) | Ni (4.0)<br>Cu (1.5)<br>Fe—61.6Mo (0.81) | 4.0Ni—1.5Cu—0.5Mo—0.15Sn | 42.1 | $H_2$ | 600 |
| Ex. 7 | $H_2SnO_3$ (0.71) | $Cu_2O$ (5.1)<br>Fe—25.0P—1.0C (1.0) | 4.5Cu—0.25P—0.01C—0.5Sn | 12.2 | $H_2$ | 850 |
| Ex. 8 | Sn (1.0) | Fe—74.7Si (4.0) | 3.0Si—1.0Sn | 4.0 | vacuum (0.01 Torr) | 400 |
| Ref. 1 | Sn (0.08) | Co (1.0) | 1.0Co—0.08Sn | 12.5 | $3H_2 + N_2$ | 400 |
| Ref. 2 | $SnO_2$ (0.19) | Ni (5.0)<br>Cu (2.0)<br>Fe—61.6Mo (1.6) | 5.0Ni—2.0Cu—1.0Mo—0.15Sn | 57.3 | $H_2$ | 600 |
| Ref. 3 | Sn (18.0) | Graphite (3.0) | 3.0C—18Sn | 0.17 | $N_2$ | 240 |
| Ref. 4 | $H_2SnO_3$ (0.71) | $Cu_2O$ (5.1)<br>Fe—27.0P (0.93) | 4.5Cu—0.25P—0.5Sn | 12.1 | $H_2$ | 950 |

TABLE 1-continued

| | Sn Source (wt %) | Sources of Other Alloying Elements (A*) (wt %) | Calculated Composition (wt %) | Weight Ratio of A* to Sn | Heating Atmosphere | Heating Temperature (°C.) |
|---|---|---|---|---|---|---|
| Ref. 5 | — | Cu (2.5) | 2.5Cu | — | $3H_2 + N_2$ | 600 |

The composite powder obtained in each of Examples 1–8 and References 1–5 was in the form of a slightly sintered cake. After pruverizing in a mortar, each composite powder was subjected to the following three kinds of tests. The results of these tests are shown in Table 2.

TEST (1)

A sample of a composite powder was embedded in a synthetic resin, and the cured resin body was ground to provide a polished surface. On the iron particles sectioned and exposed in the polished surface the manner of distribution of Sn and the other alloying element(s) was examined by means of X-ray microanalyzer (EPMA). The manner of distribution is judged to be good when each alloying element powder has concentrated on the surfaces of the iron particles and has been bonded to the iron particles, and is judged to be not good if any alloying element powder has diffused into the iron particles or if every alloying element has not been bonded to the iron particles.

TEST (2)

This test is for the puropose of numerically expressing the degree of bonding of the powder(s) containing the alloying element(s) other than Sn to the iron particles. On each composite powder produced by the heat treatment, the measurement of the particle size distribution was made to determine the amount of those particles which pass through 250 mesh sieve. When the amount of such particles is X% by weight while the total amount of the alloying element source powders (except the tin powder or tin ocmpound powder) in the initial powder mixture is Y% by weight, the degree of bonding is given by $(1-X/Y)\times 100(\%)$. When the result of this calculation is not greater than 80% the sample is judged to be good.

TEST (3)

This test is for the purpose of examining the compressibility of the sample powder. With addition of 1 wt% of zinc stearate, each composite powder was compacted in a metal die under a pressure of 5000 kg/cm$^2$, and the green density of the compacted material was measured. When the green density is not lower than 6.60 g/cm$^3$ the compressibility of the sample powder is judged to be good.

As can be seen in Table 2, the composite powders of Examples 1–8 of the invention were all excellent in the manners of distribution of the alloying elements, in the degree of bonding of the alloying element source powders to the iron particles and in compressibility.

TABLE 2

| Composite Powder | Distribution of Alloying Elements | Degree of Bonding (%) | Green Density (g/cm$^3$) |
|---|---|---|---|
| Ex. 1 | good | 90.5 | 6.67 |
| Ex. 2 | good | 83.0 | 6.85 |
| Ex. 3 | good | 87.5 | 6.82 |
| Ex. 4 | good | 98.7 | 6.87 |
| Ex. 5 | good | 86.9 | 6.77 |
| Ex. 6 | good | 87.0 | 6.81 |
| Ex. 7 | good | 90.4 | 6.78 |
| Ex. 8 | good | 92.6 | 6.77 |
| Ref. 1 | not good (partial isolation of Co powder) | 75.9 | 6.84 |
| Ref. 2 | not good (partial isolation of Ni powder and Fe—Mo powder) | 77.6 | 6.82 |
| Ref. 3 | not good (agglomeration of Sn powder) | 63.9 | 6.69 |
| Ref. 4 | not good (diffusion of Sn, Cu and P into iron powder) | 97.1 | 6.62 |
| Ref. 5 | not good (partial isolation of Cu powder) | 59.8 | 6.88 |

Figure 2:
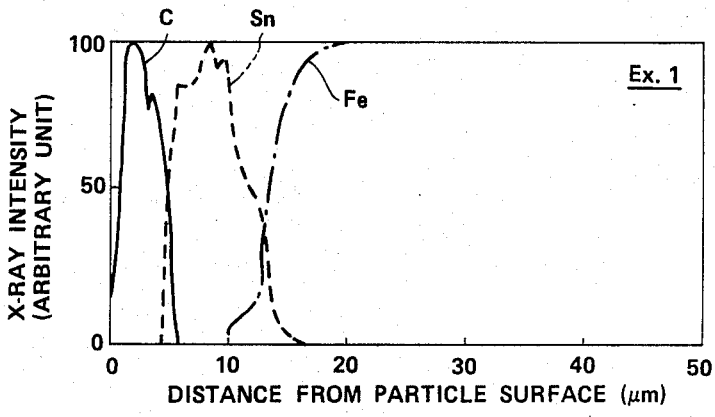
FIGS. 2 to 4 are graphs each showing concentration distributions of alloying elements in a plane sectional of an iron particle in a composite powder produced as an example of the invention examined by X-ray microanalyzer.

FIG. 2 shows the result of lineal analysis of C, Sn and Fe in a plane sectional of an iron particle of the composite powder of Example 1 by X-ray microanalyzer in the direction from the particle surface toward the particle core. In the chart of FIG. 2 a peak of Sn appears between a peak of C and a peak of Fe. This is an indication of bonding of graphite powder to the iron particle with interposition of Sn. In this case chemical reaction between C and Sn had scarcely taken place. However, Sn had reacted with Fe to some extent to result in the existence of a Fn-Sn alloy or compound on the surface of the iron particle, and slight diffusion of Sn into the iron particle had taken place, but it is evident that the diffusion had been limited within the surface region of the iron particle.

Figure 3:
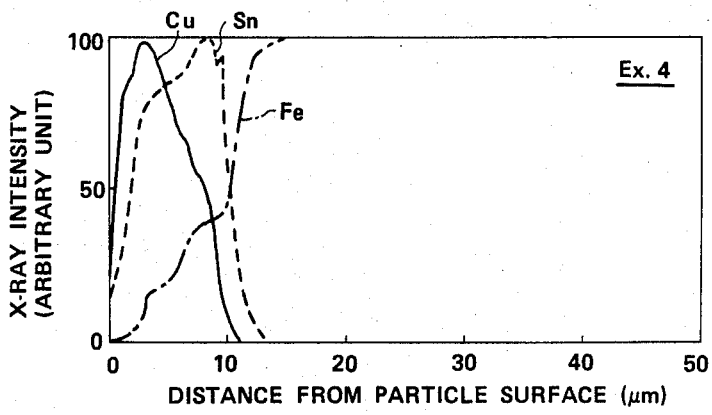

FIG. 3 shows the result of the same analysis of the composite powder of Example 4. It is understood that Cu powder is bonded to the iron particle with Sn as a cementing medium. In this case Cu had reacted with Sn to form a Cu-Sn alloy or compound. However, it is evident that still Sn had served the role of cementing medium since the position of the peak of Sn is between the Cu peak and the Fe peak.

Figure 4:
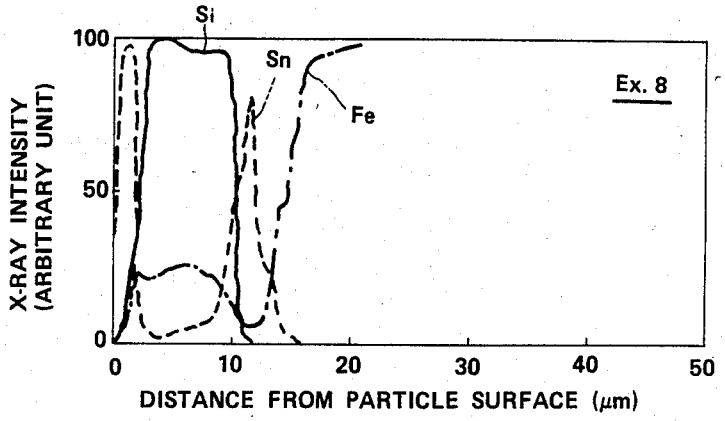

FIG. 4 shows the result of the same analysis of the composite powder of Example 8. It is understood that in this case both the ferrosilicon powder and the iron powder had been wetted with Sn to establish a strong bond as a consequence. Also in this case a peak of Sn appears between a Si peak and a Fe peak.

In Table 2, it is seen that the composite powder of Reference 1 was unsatisfactory in the manner of distribution of the alloying element and in the degree of bonding of the cobalt powder to the iron particles. The reason is because the amount of Sn was less than 0.1 wt% and, hence, was too small to work as a cementing medium or bonding assistant. The composite powder of Reference 2 had similar disadvantages. In this case the reason is that the total quantity of the powders of the selected three kinds of alloying elements was too large relative to the content of Sn. In the case of Reference 3 where the heating temperature was too low, Sn in the composite powder had agglomerated and failed to serve as a bonding assistant. In the case of Reference 4 where the heating temperature was too high, the composite powder was unsatisfactory in compressibility because of diffusion of Sn into the iron particles.

Figure 5:
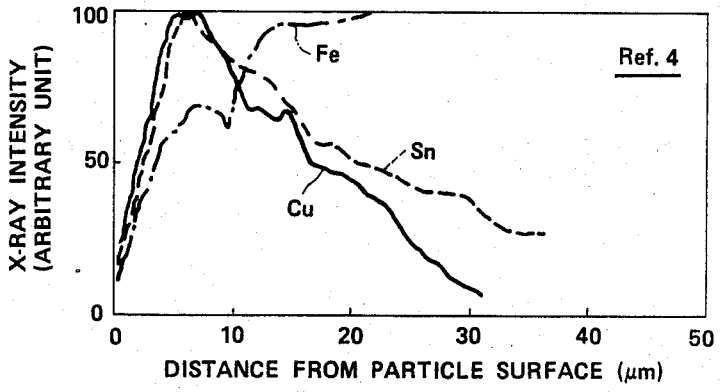
FIG. 5 shows the same matter as FIGS. 2–4 with respect to a ferrous composite powder not in accordance with the invention.

With respect to the composite powder of Reference 4, FIG. 5 shows the result of lineal analysis of Cu, Sn and Fe in a plane sectional of an iron particle by X-ray microanalyzer. It is understood that Cu and Sn had almost uniformly mixed with each other while both were in molten state and had diffused deep into the iron particle (to a depth of about 30 μm or farther). It is evident that the main reason for lowering of the compressibility of the composite powder was hardening of the iron particles as a result of deep diffusion of Sn and Cu into the iron particles.

The composite powder of Reference 5 was produced without using Sn. From a comparison between Example 4 and Reference 5, it is evident that the addition of a suitable amount Sn is remarkably effective for improvements in the manners of distribution of the alloying elements and also in the degree of bonding of the selected alloying element (Cu) powder to the iron particles.

EXAMPLES 9–12

In Example 9, a mixture of 93.4 parts by weight of an atomized iron powder (−80 mesh), 6.5 parts by weight of a metallic silicon powder (−250 mesh) and 0.1 part by weight of a metallic tin powder was heated in hydrogen gas at 1000° C. for 1 hr. The resultant cake of the mixture was pulverized into particles that passed through 80 mesh sieve.

In Examples 10, 11 and 12, the same process was repeated except that the amount of the tin powder in the powder mixture was increased to 0.3 wt%, to 1 wt% and to 3 wt%, respectively.

For comparison, the amount of the tin powder was decreased to 0.03 wt% in an additional run and to 0% (null) in a next run and was increased to 10 wt% in the last run.

The composite powders obtained in Examples 9–12 and the ones produced by the additional runs were each subjected to the Test (1) described hereinbefore to examine the manners of distribution of Si and Sn in each sample powder. By analysis by X-ray microanalyzer it was found that each of the composite powders of Examples 9–12 was comprised of silicon particles and iron particles with Sn concentrated on the surfaces of the iron particles and that a considerable portion of the silicon particles were cemented to or metallurgically bonded to iron particles.

After adding 1 wt% of zinc stearate, each of the composite powders produced in Examples 9–12 and the additional runs was compacted in a metal die under a pressure of 7000 kg/cm$^2$ into a ring-shaped body 38 mm in outer diameter, 25 mm in inner diameter and 6.5 mm in height. The compacted material was sintered in a hydrogen gas atmosphere at 1260° C. for 2 hr to thereby obtain a sample body of a sintered magnetic material.

Figure 6:
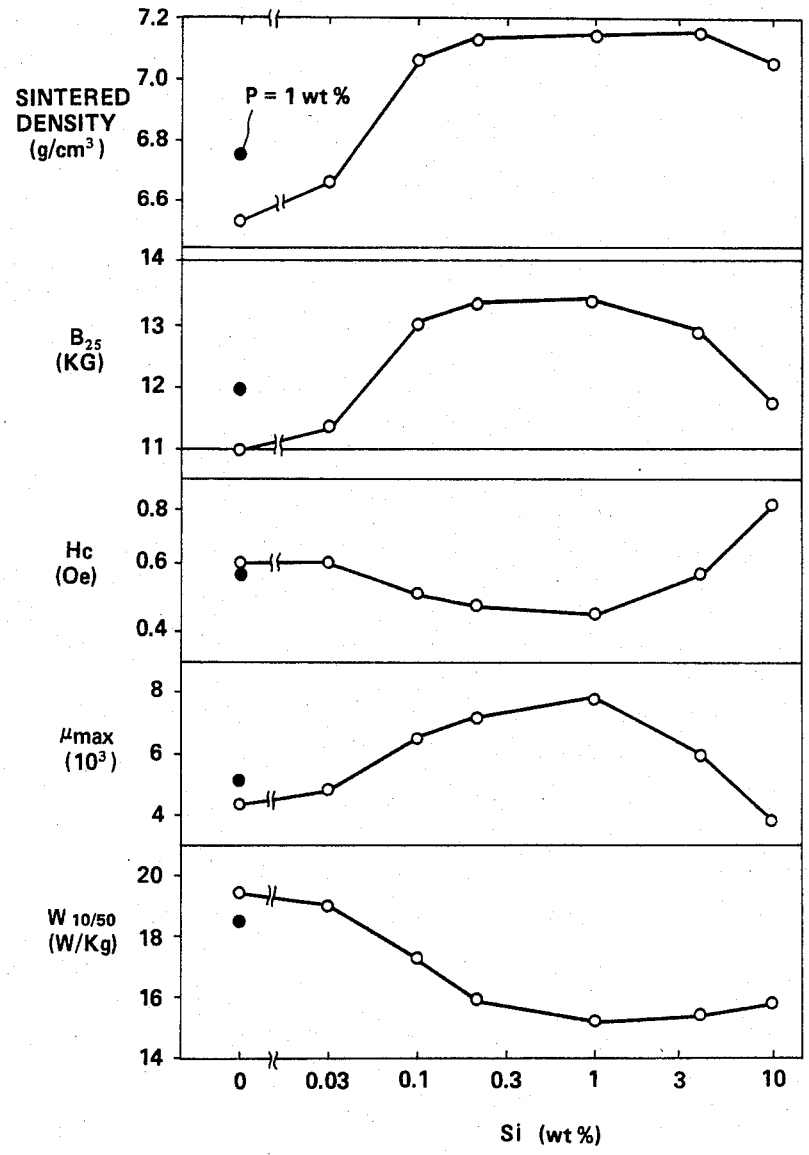
FIG. 6 is a graph showing the relationships between the amount of Sn added to an iron-silicon mixed powder and the density and magnetic characteristics of the sintered material.

The sintered samples were subjected to measurements of the density of the sintered body and magnetic characteristics. As the magnetic characteristics, magnetic flux density in a magnetic field of 25 Oe ($B_{25}$), coercive force ($H_c$), maximum permeability ($\mu_{max}$) and iron loss at a magnetic flux density of 10 kG and at a frequency of 50 Hz ($W_{10/50}$) were measured. The results are shown in FIG. 6. In FIG. 6, the black circle marks indicate the measurements obtained on a reference sample produced by compacting and sintering a powder mixture consisting of 6.5 wt% of the metallic silicon powder, 1 wt% of P (in the form of −250 mesh powder of ferrophosphorus containing 17.5 wt% of P) and the balance of Fe under the same compacting and sintering conditions.

In FIG. 6 it is seen that the Fe-Si-Sn sintered bodies of Examples 9–12 are higher in sintered density, in magnetic flux density and in permeability and smaller in iron loss than the Fe-Si sintered body and the Fe-Si-P sintered body produced for comparison and, accordingly, can be deemed superior in magnetic characteristics. FIG. 6 shows that the effects of using Sn are small when the amount of Sn is less than 0.05 wt%. Presumably this is attributed to insufficiency of α-Fe phase on the iron particle surfaces at an initial stage of sintering. Also it is seen that the magnetic characteristics of the sintered material are considerably degraded as the content of Sn exceeds 7 wt%. Presumably this is because of reaction of Sn with Fe at an initial stage of sintering to form a certain Fe-Sn compound which constitutes obstruction to the diffusion of Si into the iron particles.

EXAMPLES 13–17

In Example 13, an atomized pure iron powder (−80 mesh), a ferrosilicon (Si 77 wt%) powder (−250 mesh), a metallic tin powder (−250 mesh) and a ferrophosphorus (P 17.5 wt%) powder (−250 mesh) were mixed so as to obtain a powder mixture containing 6.5 wt% of Si, 1 wt% of Sn and 1 wt% of P. This powder mixture was heated in hydrogen gas at 1000° C. for 1 hr. The resultant cake of the mixture was pulverized into particles that passed through 80 mesh sieve.

In Examples 14, 15, 16 and 17, the same process was repeated except that the amount of the ferrophosphorus powder was decreased such that the content of P in the powder mixture was 0.3 wt% in Example 14, 0.1 wt% in Example 15, 0.03% wt% in Example 16 and 0% (null) in Example 17.

For comparison, the content of P in the powder mixture was increased to 3 wt% in an additional run.

The composite powders of these examples were each subjected to the Test (1) described hereinbefore. The analysis by X-ray microanalyzer revealed that each of the composite powders of Examples 13–17 was comprised of ferrosilicon particles, ferrophosphorus particles (except Example 17) and iron particles with Sn concentrated on the surfaces of the iron particles and that considerable portions of the ferrosilicon particles and ferrophosphorus particles were cemented to or metallurgically bonded to iron particles.

After adding 1 wt% of zinc stearate, each of the composite powders produced in Examples 13–17 and the additional run was compacted and sintered by the same method and under the same conditions as in Example 9. The sintered samples were subjected to measurements of the density of the sintered body and magnetic characteristics as described in Examples 9–12. The results are shown in FIG. 7.

Figure 7:
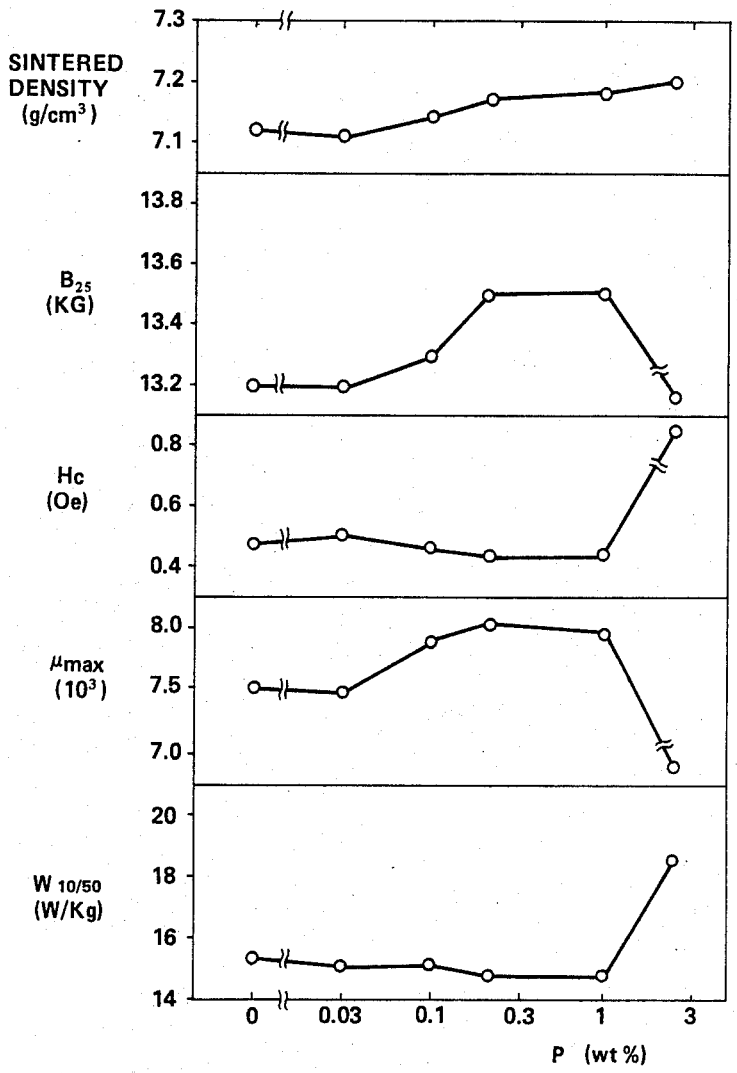
FIG. 7 is a graph showing the relationships between the amount of P added to a Sn-containing iron-silicon composite powder and the density and magnetic characteristics of the sintered material.

From a comparison between the data in FIG. 7 and the corresponding part of the data in FIG. 6, it is apparent that the addition of 0.05–2 wt% of P to a Fe-Si-Sn sintered material according to the invention produces further improvements on the magnetic characteristics of the sintered material.

What is claimed is:

1. A tin-containing ferrous composite powder useful as the raw material of a ferrous sintered alloy, the composite powder comprising:

a primary powder of which the principal material is Fe and which is substantially free of Sn;

at least one secondary powder which comprises at least one alloying element selected from the group consisting of C, Co, Cr, Cu, Mn, Mo, Ni, P and Si; and tin in such a form that the individual particles of said primary powder and at least a portion of the particles of said at least one secondary powder are at least partially coated with Sn such that particles of said at least one secondary powder are bonded to the individual particles of said primary powder via said Sn, the content of Sn in the composite powder being in the range from 0.1 to 20 wt%, and the ratio of the total weight of said at least one alloying element in the composite power to the weight of Sn in the composite powder being not greater than 50:1.

2. A composite powder according to claim 1, wherein said primary powder is a substantially pure iron powder.

3. A composite powder according to claim 1, wherein said primary powder is a low-alloy iron powder.

4. A composite powder according to claim 1, wherein the particles of said at least one secondary powder are smaller in size than the particles of said primary powder.

5. A method of producing a tin-containing ferrous composite powder, the method comprising the steps of:

mixing a primary powder of which the principal material is Fe and which is substantially free of Sn with at least one secondary powder, which comprises at least one alloying element selected from the group consisting of C, Co, Cr, Cu, Mn, Mo, Ni, P and Si, and at least one Sn-source powder selected from the group consisting of tin powder and powders of tin compounds that undergo thermal decomposition to liberate Sn in such proportions that the content of Sn in a resultant powder mixture is in the range from 0.1 to 20 wt% and that the ratio of the total weight of said at least one secondary powder to the weight of Sn is said mixture is not greater than 50:1; and heating said powder mixture in a nonoxidizing atmosphere at a temperature in the range from 250° to 900° C.

6. A method according to claim 5, wherein said primary powder is a substantially pure iron powder.

7. A method according to claim 5, wherein said primary powder is a low-alloy iron powder.

8. A method according to claim 5, wherein the particles of said at least one secondary powder are smaller in size than the particles of said primary powder.

9. A method according to claim 5, wherein said tin compounds are tin oxides, tin hydroxides, tin chlorides, tin sulfides, tin nitrates and tin sulfates.

10. A method according to claim 5, wherein said nonoxidizing atmosphere is a reducing atmosphere.

11. A method according to claim 5, wherein the heating of said powder mixture is carried out under reduced pressure.

12. A tin-containing ferrous composite powder comprising:

an iron powder;

at least one Si-containing powder selected from the group consisting of silicon powder and ferrosilicon powders; and tin in such a form that at least a portion of the particles of said iron powder are at least partially coated with Sn, the content of Si in the composite powder being in the range from 1 to 12 wt%, and the content of Sn in the composite powder being in the range from 0.05 to 7 wt%.

13. A composite powder according to claim 12, further comprising a P-containing powder selected from the group consisting of red phosphorus powder and ferrophosphorus powders, the content of P in the composite powder being in the range from 0.05 to 2 wt%.

14. A ferrous sintered magnetic material consisting essentially of 1 to 12 wt% of Si, 0.05 to 7 wt% of Sn and the balance of Fe particles physically combined by Sn bonding.

15. A ferrous sintered magnetic material consisting essentially of 1 to 12 wt% of Si, 0.05 to 7 wt% of Sn, 0.05 to 2 wt% of P and the balance of Fe particles physically combined by Sn bonding.

* * * * *